US007516746B1

(12) United States Patent
Davis

(10) Patent No.: US 7,516,746 B1
(45) Date of Patent: Apr. 14, 2009

(54) STATUS INDICATOR

(76) Inventor: Susan Davis, 83 River St., Andover, MA (US) 01810

( * ) Notice: Subject to any disclaimer, the term of this patent is extended or adjusted under 35 U.S.C. 154(b) by 478 days.

(21) Appl. No.: 11/307,183

(22) Filed: Jan. 26, 2006

(51) Int. Cl.
*B08B 3/00* (2006.01)

(52) U.S. Cl. ..... 134/113; 134/58 D; 134/58 DL; 134/104.1; 134/104.3; 134/137

(58) Field of Classification Search ..... 134/113, 134/58 D, 58 DL, 104.1, 104.3; 116/216, 116/217, 218, 221, 280, 297, 298, 303, 305, 116/200, 223, 224, 281, 282; 374/141, 206
See application file for complete search history.

(56) References Cited

U.S. PATENT DOCUMENTS 4,129,954 A 12/1978 Hulteen ..... 40/607
4,353,990 A * 10/1982 Manske et al. ..... 435/287.4
4,653,423 A 3/1987 Schafer ..... 116/228
4,723,745 A * 2/1988 Conway ..... 248/205.3
5,467,545 A * 11/1995 Zillner ..... 40/597
5,477,872 A * 12/1995 Berg ..... 134/52
5,839,458 A 11/1998 Delcarson ..... 134/113
5,884,641 A * 3/1999 Berg ..... 134/113
6,196,239 B1 3/2001 Eskey ..... 134/113
6,367,184 B1 * 4/2002 Kheder ..... 40/617

FOREIGN PATENT DOCUMENTS

GB 2339626 B1 * 2/2000

* cited by examiner

*Primary Examiner*—Michael Barr
*Assistant Examiner*—Rita R Patel
(74) *Attorney, Agent, or Firm*—Mark P. White

(57) ABSTRACT

A status indicator for a dishwasher that has a front-loading door and an upper basket having a wire frame within the dishwasher is made up of a body and a hook, where the hook is rotatingly affixed to the wire frame of the upper basket in one of two positions, the first position with the body rotated onto the outside of the upper basket so that the door is kept in an open state, and a second position, in which the body is rotated to the inside of the upper basket, so that the door is left in a closed state, and wherein the body of the indicator may be vertically rotated to display one of two rubrics, one indicating clean dishes, and the other dirty dishes.

2 Claims, 4 Drawing Sheets

1
2
4
3

STATUS INDICATOR

DESCRIPTION RELATIVE TO THE PRIOR ART

A common domestic complaint in the use of automatic dishwashers is that some people in the family cannot tell whether the contents of the dishwasher are dirty or clean. This problem is exacerbated when clean dishes are left in the dishwasher after drying for several days. Thus the dishwasher may be only partly full of clean dishes, which superficially resembles the situation whereby the dishwasher is full of dirty dishes.

These two situations may be more than superficial. In some households a person filling the dishwasher may rinse the dishes so fastidiously that it is difficult to tell the difference between clean and dirty dishes. Nevertheless, even when the dishes are so thoroughly rinsed that they appear clean to the naked eye, passing the dishes through a wash cycle still has the additional benefit of sterilizing the dishes, due to the temperature of the hot water used.

Rewashing dishes already passed through an entire wash cycle has few if any benefits. It is anti-environmental, since it uses resources such as soap, electricity, and hot water needlessly. The present invention thus provides clear environmental benefits.

The prior art contains many examples of devices used to solve this problem. However the present invention is not only easier to use than those of the prior art, but also has a benefit that the prior art does not in that it props the door of the dishwasher open when the dishes are dirty, so that the user can tell from a glance at the dishwasher the state of the dishes within, and allows for air drying of the clean dishes.

Furthermore the status indicator of the present invention need never be removed from the dishwasher, since its two states are achieved by simply rotating the status indicator from one position to the next. It is unobtrusive so that it does not interfere with the dishes, nor does it have to be removed to take out dishes or put in new dishes.

SUMMARY OF THE INVENTION

It is an object of this invention to provide a device which displays whether the dishes in a dishwasher are clean or dirty. It is a further object of this invention to make such a device which is inexpensive, easy to use, and does not interfere with the loading and unloading of the dishwasher.

In accordance with one aspect of the invention the status indicator is designed for use with a dishwasher having a front loading door and an upper basket composed of wire frame.

In accordance with a second aspect of the invention the status indicator is made up of a body and a hook affixed to each other and the hook rotatingly affixed to the wire frame in one of two positions: the first position with the body on the inside of the upper basket so that the door may be closed, and a second position with the body disposed on the outside of the upper basket, causing the door to remain partially open.

In accordance with a third aspect of the invention the body has two sides, with an indication on one side that the dishes within are dirty, and an indication on the other side that the dishes within are clean.

In accordance with a fourth aspect of the invention a vertically rotating joint connects the body and the hook.

In accordance with a fifth aspect of the invention a hook closure is used to retain the hook to the basket wire.

In accordance with a sixth aspect of the invention the body of the status indicator has a pyramidal shape.

In accordance with a seventh aspect of the invention a horizontal rotating joint connects the body and the hook.

BRIEF DESCRIPTION OF DRAWINGS

The invention will be more fully described in the following detailed description in conjunction with the drawings in which.

DESCRIPTION OF THE PREFERRED EMBODIMENTS

Figure 1:
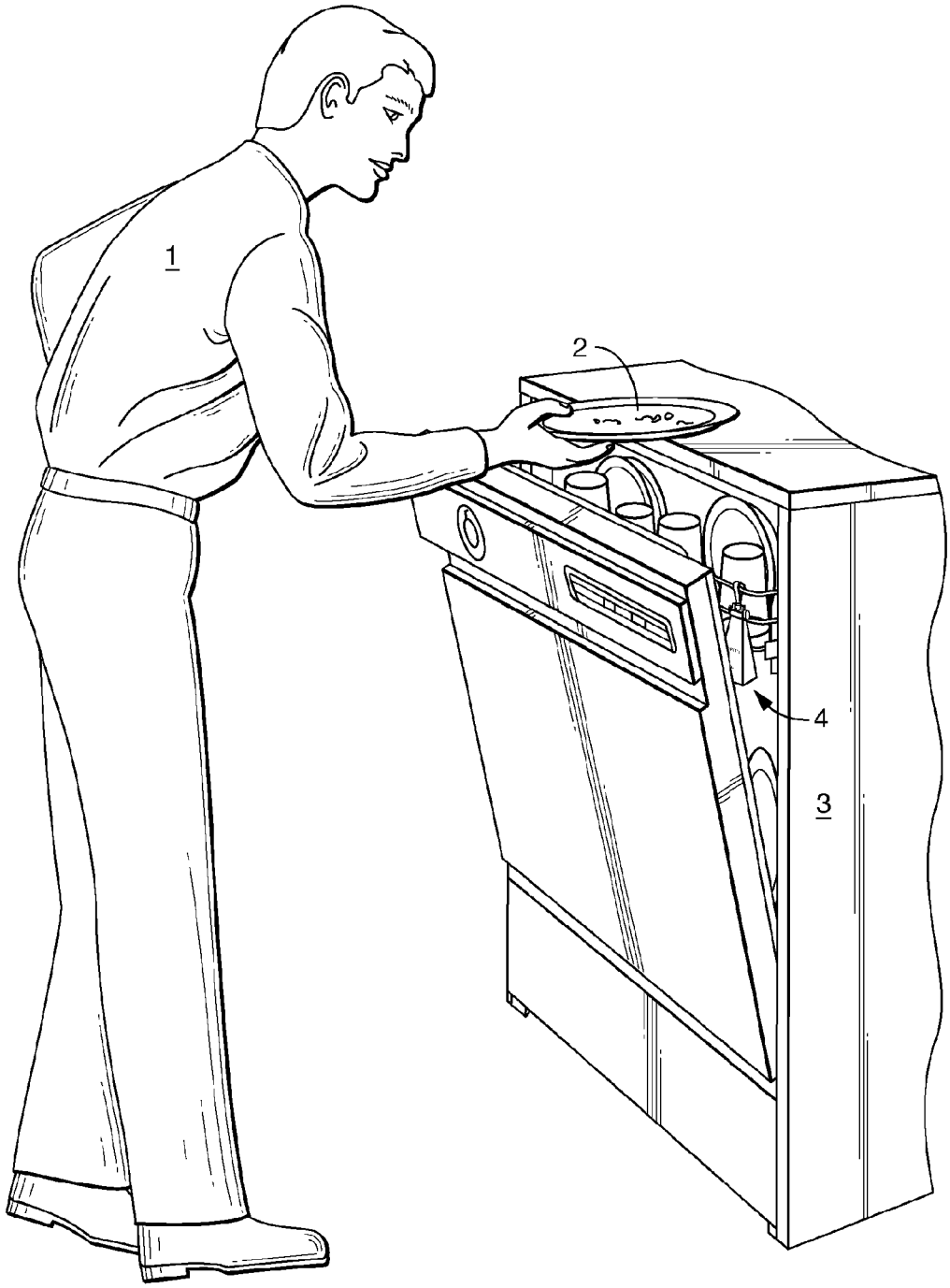
FIG. 1 depicts a user loading a dishwasher containing the status indicator.

The device may be understood by first referring to FIG. 1, in which a user 1 is loading a dish 2 into a typical front-loading dishwasher 3. The status indicator is seen within the dishwasher. This figure demonstrates how the status indicator acts as a "stop" to keep the door of the dishwasher from closing, since it is rotated to a position outside of the upper basket 6 of the dishwasher, an thus prevents the door from closing completely. This figure shows how the status indicator is suspended from the upper wire 7 of the upper basket, as seen in FIG. 2.

Figure 2:
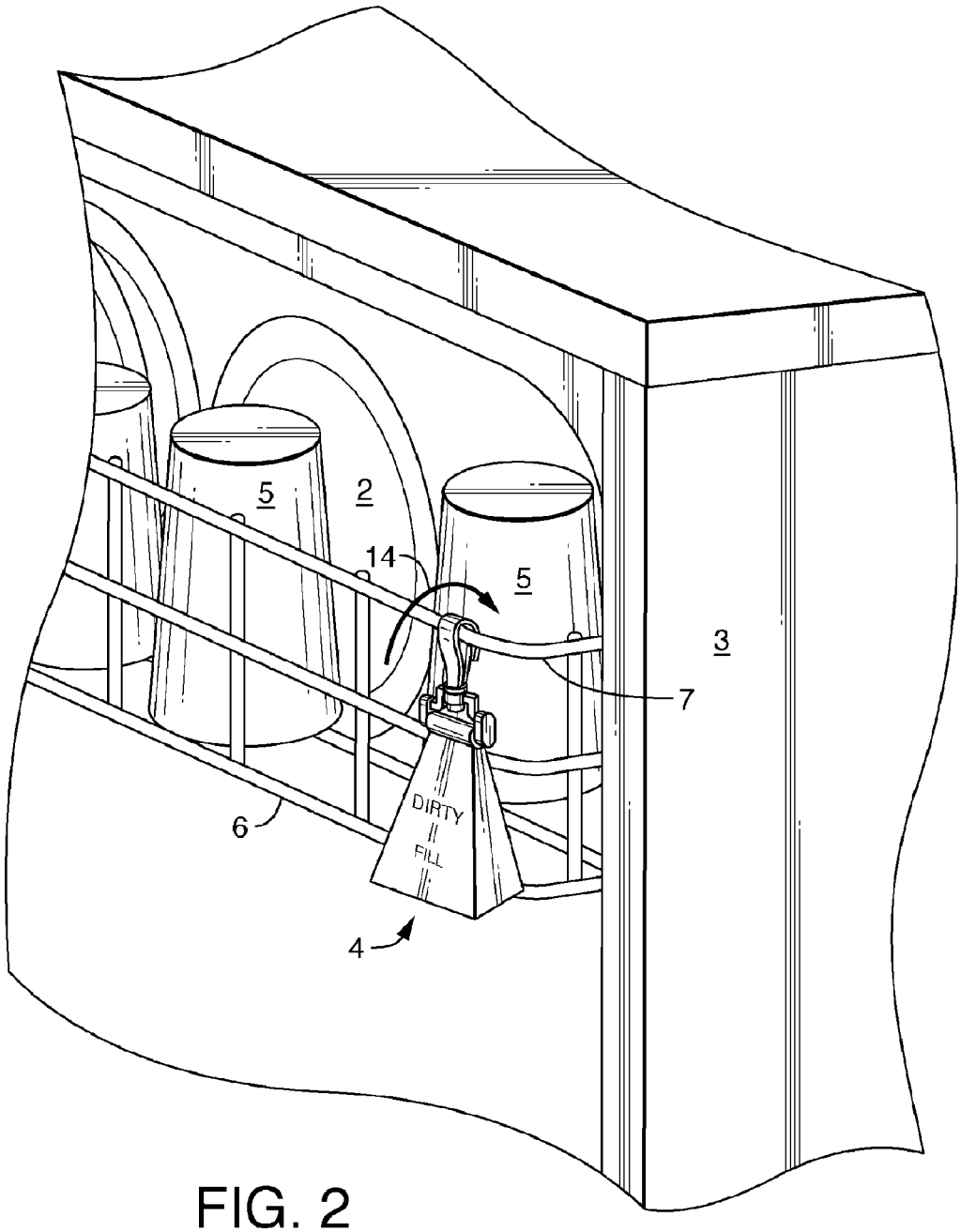
FIG. 2 depicts a perspective view of the status indicator within the dishwasher disposed outside of the upper basket.

Referring next to FIG. 2, a close-up view of the dishwasher of FIG. 1 is depicted. The upper basket 6 is shown in detail. The upper basket appears filled, and contains both dishes 2 and glasses 5. For the purpose of this invention the word "dishes" will be used to refer to both dishes and glasses, and additionally to other objects typically placed within a dishwasher.

The status indicator 4 in FIG. 2 contains the rubric "dirty" and "fill", indicating that the contents of the dishwasher contain dirty dishes, and the user may continue to fill the dishwasher with additional dirty dishes. The status indicator may be vertically rotated about the hook to display the rubric "clean" or "fill". The rubric displayed on the body of the status indicator shows that the dishes within the dishwasher are clean, and that the dishwasher should be emptied.

Figure 3:
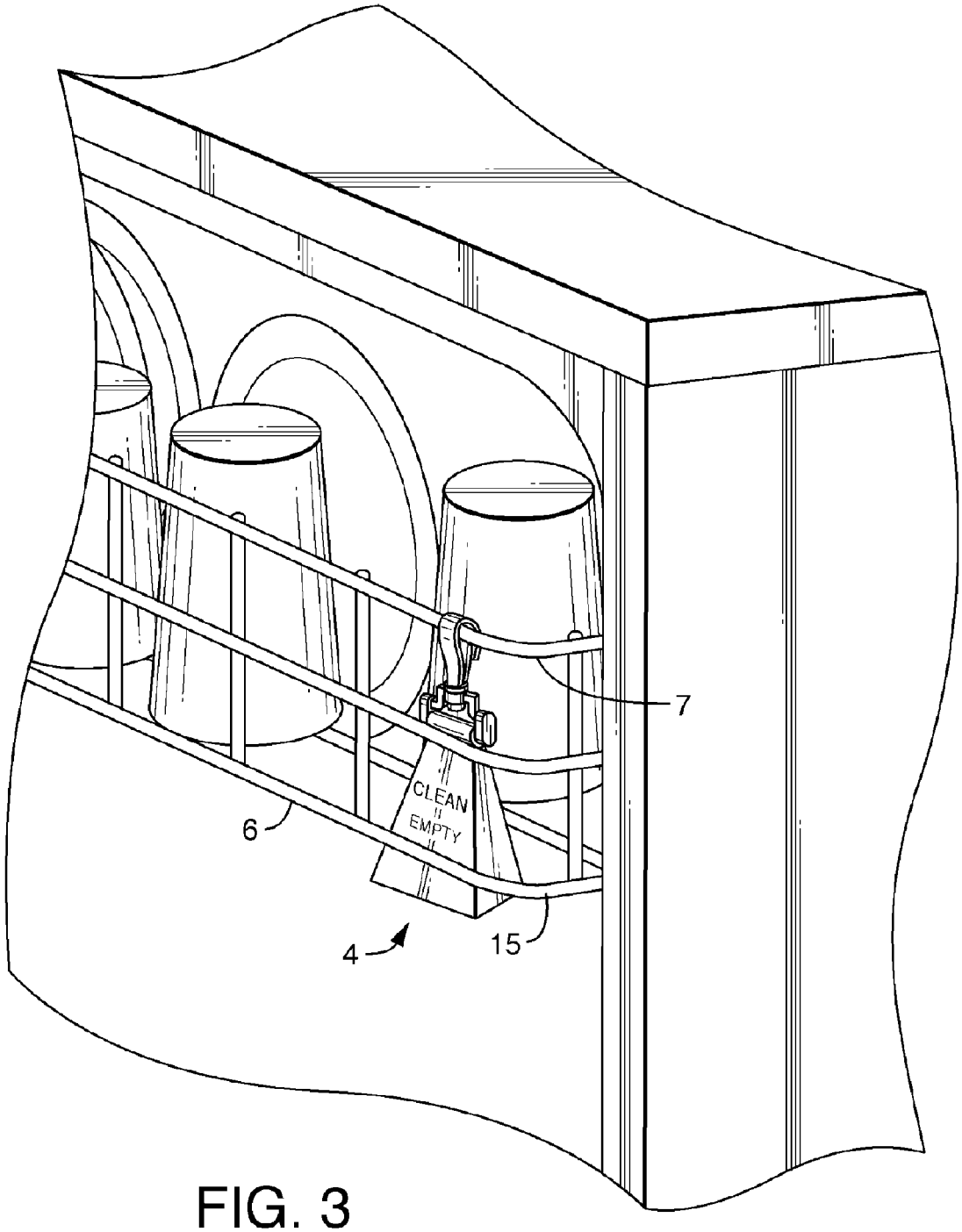
FIG. 3 depicts a perspective view of the status indicator within the dishwasher disposed inside of the upper basket.
Figure 4:
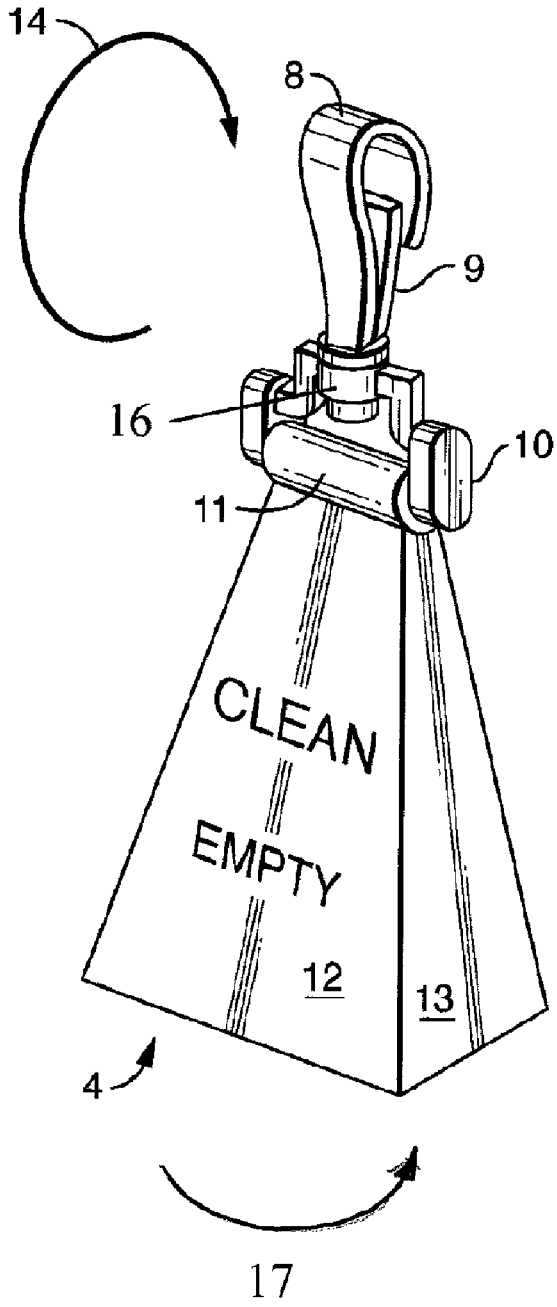
FIG. 4 shows a detailed perspective view of the status indicator.

Referring next to FIG. 3, it is seen that the status indicator has been rotated about the upper wire 7 of the upper basket by use of the hook 8, as seen in FIG. 4, which is an integral part of the status indicator. The rotation 14 has been in the direction shown by the arrow of reference number 14 in FIG. 2, so that it now resides inside of the upper basket 7. Still referring to FIG. 3 the status indicator body extends below the bottom wire 6 of the upper basket, but the status indicator is so configured in proportion to the upper basket so that it does not interfere with any of the dishes stacked in either the upper basket or the lower basket (not shown).

FIG. 4 shows a detailed perspective view of the status indicator itself in its preferred embodiment. The body of the status indicator is pyramidal in shape, having a front 12 and back, and a right side 13 and left side. The back and right side are not shown since the pyramid in this embodiment is symmetrical along orthogonal axes which intersect the midpoints of the front and side at the base of the pyramid.

The status indicator has a hook 8 with a closure 9, so that when the status indicator is affixed to a wire of the upper basket it cannot be accidentally removed. The hook is rotatingly attached to the body of the status indicator by means of a vertical rotating joint 16 allowing the body front and back to be exposed to view. This vertical rotating joint allows the status indicator to rotate in the direction 17 as seen in FIG. 4. It is an important feature of the present invention because it allows the body of the status indicator to swivel to display the desired rubric, whether the status indicator is within or without the upper basket.

A horizontal rotating joint contains a cylindrical member 11 which contains a rotating pin (not shown) affixed at each end to the ends of the unshaped frame 10 of the status indicator. This horizontal rotating joint is an important feature of the present invention because it allows the body of the status indicator to be easily maneuvered into any position necessary when rotated to the inside of the upper basket.

In use the dishwasher is first filled with the status indicator located on the outside of the upper basket with the rubric "dirty fill" exposed to view. The filling process may take several days, and the door remains slightly ajar, which is obvious to the user even from across the room. When the dishwasher is filled to the point where the user decides to turn it on, the status indicator is rotated to the inside of the upper basket. The dishwasher is then started, and the user need not worry about confusing anyone as to the status of the dishes. When the dishwasher is opened the status indicator may be flipped to the outside of the upper basket, changing the status indicator so that it reads "clean empty". So even if a few dishes are removed now and then, the door to the dishwasher will be slightly open to the air, and anyone opening the dishwasher will be reminded that the dishes within are clean, and that the dishes should be removed. The user may not follow the instructions and empty the dishwasher, but the next user will still be reminded that the dishes are clean and that the dishwasher still needs to be emptied.

When the last of the clean dishes is removed from the dishwasher the user then rotates the status indicator back to the "dirty fill" position on the inside of the upper basket, and everyone in the household is prompted to start to load dirty dishes in the dishwasher again.

Referring again to FIG. 4, it is seen that a second rotating joint 16 is important in cases where a user may want to rotate the indicator on the outside of the basket, but still have the option of showing either the "clean empty" or "dirty fill" rubric without unhooking the status indicator from the upper basket wire. The same is also true if the user wishes to leave the status indicator inside the basket with either rubric visible.

The status indicator described herein can also be used to advantage in a variety of other structures having a horizontal wire, or wire-like member. For instance, the status indicator can be hooked onto the uppermost wire on the front of a wire basket, and rotated so that it falls either without or within the basket.

Likewise, a wire shelf, of the type commonly seen in new homes, has horizontal wires on the front edge of the shelf, as well as a parallel wire below the shelf to give it additional support. The status indicator can be used to indicate the kind of articles stored on the shelf itself.

The status indicator as described herein can be used in conjunction with many other wire structures having characteristics similar to the baskets and shelves mentioned above. The main requirement of such a structure is only that the status indicator can be rotated into one of two positions, with the status indicator containing a rubric identifying each of the two positions.

While the invention has been described with reference to specific embodiments, it will be apparent that improvements and modifications may be made within the purview of the invention without departing from the scope of the invention defined in the appended claims.

What is claimed is:

1. A status indicator for a dishwasher comprising a door and an upper basket having a wire frame, the status indicator comprising:

(a) a body;

(b) a hook; and (c) rubric means to display whether the dishes within are clean or dirty, wherein the hook is rotatingly affixed to the wire frame in one of two positions, the first position with the body disposed on the inside of the upper basket so that the door may be closed, and a second position with the body disposed on the outside of the upper basket so that the door remains partially open, and further comprising a vertical rotating joint between the body and the hook, so that the status indicator can display either the clean rubric or the dirty rubric.

2. The status indicator of claim 1 further comprising a horizontal rotating joint between the body and the hook.

* * * * *